US007434955B2

(12) United States Patent
Vickers et al.

(10) Patent No.: US 7,434,955 B2
(45) Date of Patent: Oct. 14, 2008

(54) FLASHLIGHT SYSTEM

(75) Inventors: John M. Vickers, Offham (GB); Ben O. Scruggs, Prairie Village, KS (US)

(73) Assignee: Premierlight Limited, Kent (GB)

( * ) Notice: Subject to any disclaimer, the term of this patent is extended or adjusted under 35 U.S.C. 154(b) by 364 days.

(21) Appl. No.: 10/963,869

(22) Filed: Oct. 13, 2004

(65) Prior Publication Data

US 2006/0077657 A1 Apr. 13, 2006

(51) Int. Cl.
*F21L 4/04* (2006.01)

(52) U.S. Cl. ..... 362/205; 362/208; 362/227; 362/231; 362/252

(58) Field of Classification Search ..... 362/205, 362/208, 227, 231, 251, 252; 200/60, 519, 200/547–551, 530–532

See application file for complete search history.

(56) References Cited

U.S. PATENT DOCUMENTS

| | | | | |
|---|---|---|---|---|
| D425,226 | S | 5/2000 | Galli | |
| D455,513 | S | 4/2002 | Galli | |
| 6,614,336 | B2 * | 9/2003 | Galli | 335/205 |
| D486,937 | S | 2/2004 | Shiu | |
| 6,942,357 | B2 * | 9/2005 | Parsons et al. | 362/183 |
| 2004/0240204 | A1 * | 12/2004 | Russ et al. | 362/231 |

* cited by examiner

*Primary Examiner*—Sandra O'Shea
*Assistant Examiner*—Mark Tsidulko
(74) *Attorney, Agent, or Firm*—John C. McMahon

(57) ABSTRACT

An energy efficient flashlight system having multiple lighting display modes and a single operating switch that enables a user to step through the modes. The flashlight illuminates via the use of a plurality of light emitting diodes (LEDs) that preferably contain at least two colors, such as red and white, and are designed to coordinate in order to provide the plurality of modes including an emergency signaling mode, a red map reading mode or directional pointing mode and a bright illumination mode. The flashlight enables a user to hold, operate and toggle between modes using a single hand.

17 Claims, 2 Drawing Sheets

FLASHLIGHT SYSTEM

BACKGROUND OF THE INVENTION

The present invention is directed to a flashlight system, and more particularly, to such a flashlight system with a single operating switch that steps or toggles through a plurality of light display modes, including an emergency signaling mode, a red map reading or directional laser navigation mode, a bright illumination mode and an off mode.

Flashlights having multiple lighting display settings or modes have been previously produced. Typically, such flashlights have a primary illumination mode for traditional flashlight use along with a variety of other modes. A limitation with prior art flashlights is that in order to select a desired mode, a user must use two hands to manipulate the flashlight with one supporting the flashlight while the other adjusts an appropriate mode-activation switch, because the switch requires twisting or other manipulation or because multiple switches are utilized that require the user to move between such switches or the switch must be slid along a track to a plurality of different positions. Further, selection of the appropriate mode often requires the user to view an indicia or label on the flashlight, which may be obscured, especially when there is insufficient light. This requirement is unnecessarily complicated and burdensome, especially to handicapped users with impaired dexterity or vision.

Some flashlight manufacturers have began replacing traditional filament light bulbs with light emitting diodes or "LEDs", which provides a number of advantages. Most significantly is an improvement in energy efficiency. LEDs provide a light source lasting for an amount of time that is substantially longer than traditional light bulbs. While a single LED has dimmer light emission capabilities, which is adequate for some applications, a grouping or cluster of strategically placed LEDs can greatly compound the light emission of a single LED.

Another advantage of utilizing LEDs opposed to filament bulbs is heightened design options. For instance, when employing a design that utilizes a cluster of LEDs, it is much easier to design a flashlight capable of emitting light of various colors. Specifically, because there are multiple light sources, i.e. LEDs, such flashlights facilitate the introduction of LEDs with various colors, thus adding to the functionality of such flashlights. It is advantageous to provide a flashlight having LEDs of different colors other than white such as red for aesthetic and/or functional purposes. For instance, red light is ideal in situations where the user does not want disrupt normal night vision and by utilizing a flashlight having a red light rather than a white light, the user can employ the flashlight in dark environments without interfering with normal night vision.

The use of a traditional white light would cause the user's eyes to adjust in order to become accustom to the white light and require the user's eyes to readjust to the darkness after switching the flashlight off. An example of ideal use of a red light is the situation where the user wants to quickly reference a map while driving at night. Disruption of the user's night vision from a white light in this scenario could result in catastrophe. It is also desirable to provide modes of operation that group different lights for purpose of altering the intensity of the light or providing an intermittent light for emergency or signaling purposes.

SUMMARY OF THE INVENTION

The present invention addresses the continuing need to improve the design, operation and energy efficiency of flashlights and especially the user-friendliness of such flashlights. The present flashlight includes a simple push button mode-select switch, which allows a user to select one of a number of flashlight modes by simple depression of the switch with the thumb while the other fingers of the hand grip the body of the flashlight. The modes may include an emergency signaling mode, a red map reading or directional laser mode and a bright illumination mode. The flashlight has a number of white light emitting diodes (LEDs) situated in a cluster configuration on one end of a tubular body with a red LED located in the center of the cluster. For example, the modes may include all off, red light LED on, all white light LEDs on and all white light LEDs flashing on in an emergency signal. As the user toggles from mode to mode by depressing the mode-selection switch, the LEDs alternate from on and off positions depending on the mode. In the emergency signaling mode, all white light LEDs automatically cycle on and off or pulse in accordance with the universal SOS signal followed by a pause with the pattern repeating thereafter until the mode is changed. In the red map reading or directional laser mode, all white light LEDs are off with the center red light LED on. In the bright illumination mode, all of the white light LEDs are on and the red light LED is off.

OBJECTS AND ADVANTAGES OF THE INVENTION

Therefore, the objects of the present invention are: to provide an improved flashlight; to provide such a flashlight system that is energy efficient; to provide such a flashlight having a plurality of modes; to provide such a flashlight system that has a single mode selector switch that is operable using a single finger; to provide such a flashlight that is capable of toggling between a plurality of modes using the mode selector switch; to provide such a flashlight that can be used with one hand; to provide such a flashlight utilizing multiple white light LEDs for increased brightness; to provide such a flashlight having a plurality of modes and that allows a user to alternate between modes while holding the flashlight with one hand; to provide such a flashlight that has operational modes that include off, white light on only, reading or laser light on only and white light flashing in an emergency signaling sequence; to provide such a flashlight which can be produced at an economical cost, enabling sales to a mass consumer market; to provide such a flashlight system which is attractive, rugged, reliable and which is particularly well-suited for the intended purpose thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
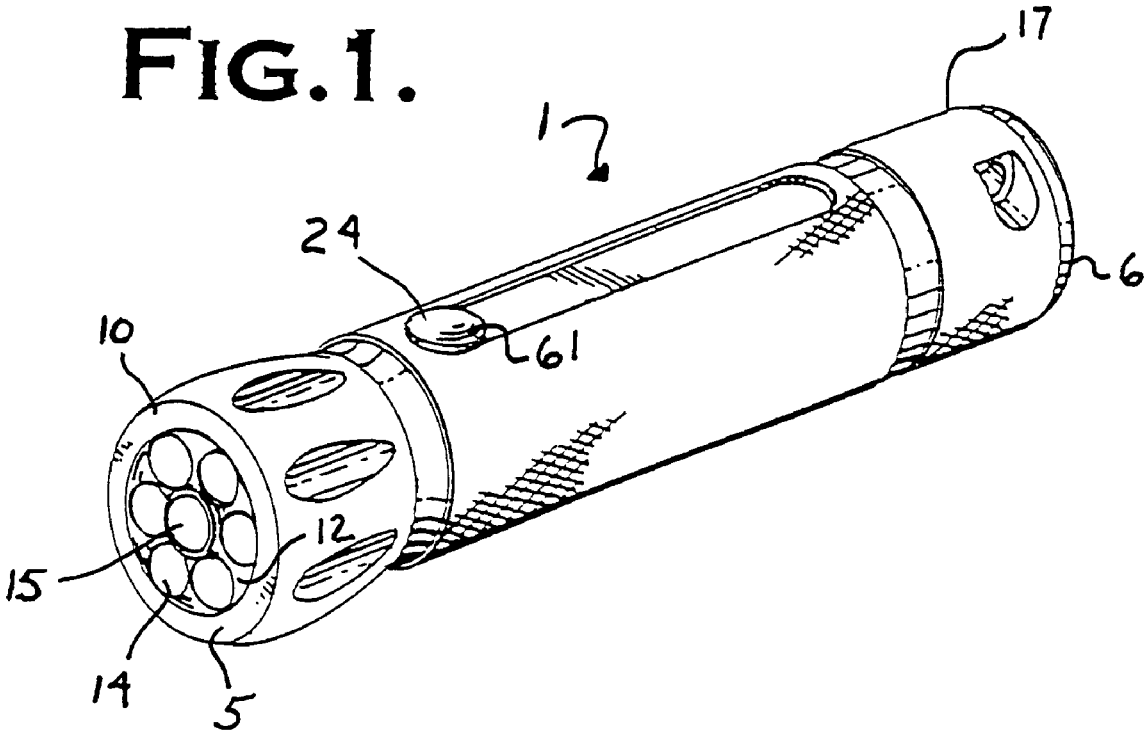
FIG. 1 is a perspective view of a flashlight in accordance with the present invention.
Figure 2:
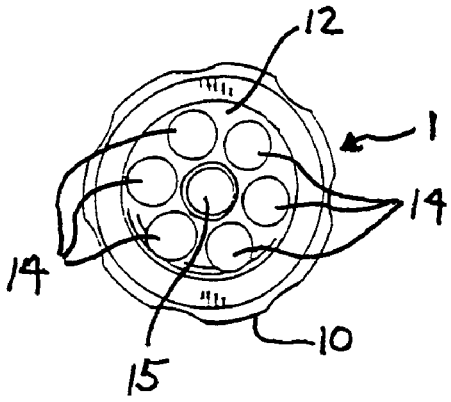
FIG. 2 is a front elevational view of the flashlight.
Figure 3:
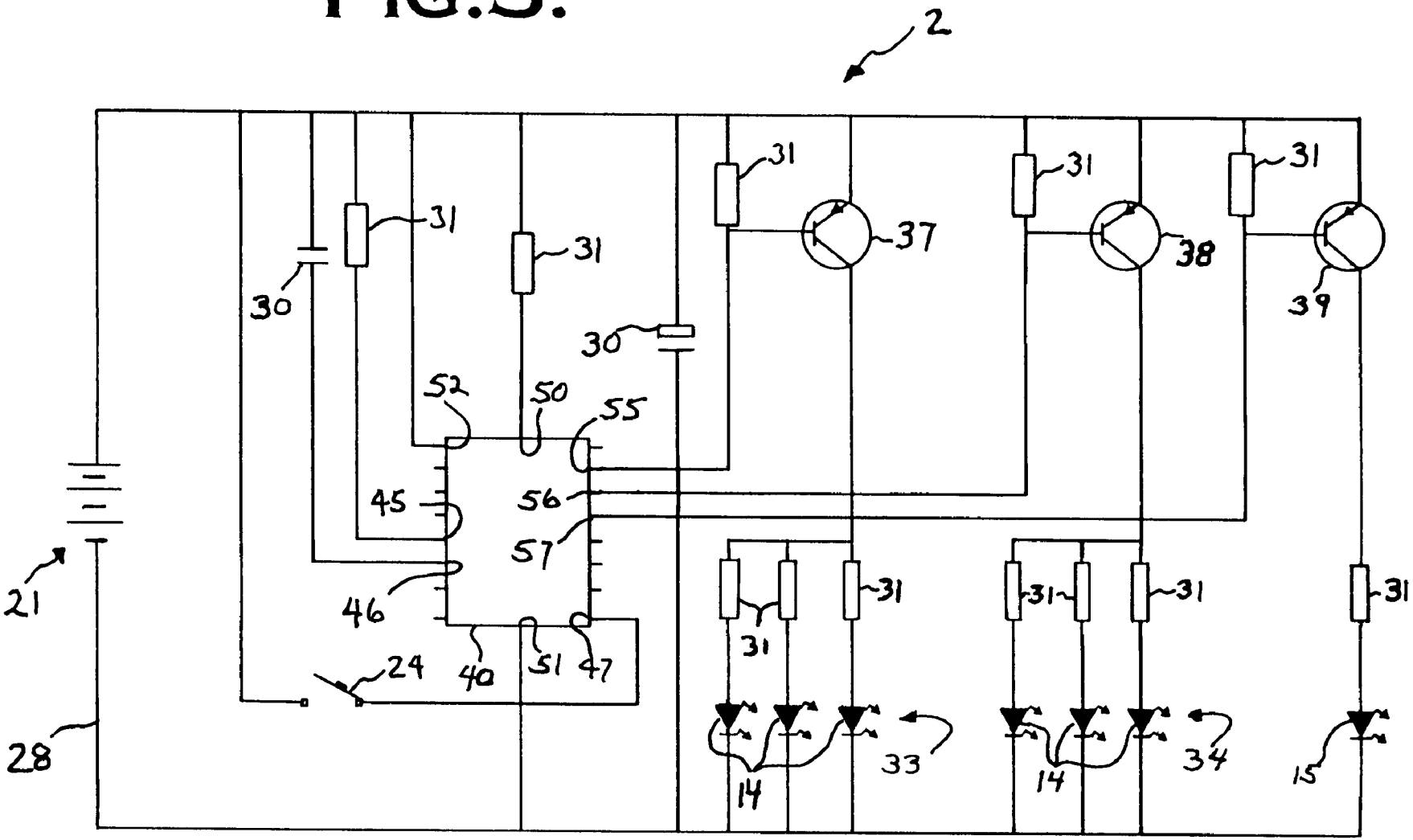
FIG. 3 is an electrical schematic of an electrical system of the flashlight.

The reference number 1 generally represents a flashlight in accordance with the present invention and as depicted in FIGS. 1 and 2. An electrical circuit 2 for illustrated embodiment of the flashlight 1 is shown in FIG. 3. The flashlight 1 has a metal tubular housing 3, although it is foreseen that the housing 3 may be constructed of high-impact plastic or other like material. The housing 3 has front and rear ends 5 and 6 with the front end 5 having a screw on front cap 10 with a lens 12. Within the cap 10 and behind the lens 12 is a cluster of six (6) white light producing LEDs 14 that are situated in a circular pattern. Furthermore, a seventh red light producing LED 15 is centrally located and surrounded by the white light LEDs 12. It is foreseen that the cluster of LEDs can contain any number of LEDs in order to satisfy the intended design. On the rear end 6 is a rear cap 17 that opens into a compartment for a 6-volt battery 21 that is shown in FIG. 3.

Located on the housing 3 in a location that is especially adapted to be operated by a user's thumb when the housing 3 is held in the hand of a user is a single operating switch 24 that is of a push button type and adapted for stepping through multiple lighting display modes by successive depression of the switch 24. The circuit 2 shown in FIG. 3 is a rough schematic of the electrical system of the flashlight 1. In general, the circuit 2 includes the battery 21 joined by electrically conductive wiring 28 to the remaining elements of the circuit 2. In general, the circuit 2 includes capacitors 30 and resistors 31. The white light LEDs 14 are grouped in two banks 33 and 34. Three transistors 37, 38 and 39 are utilized to power the banks 33 and 34 and the red light LED 15 respectively.

An integrated circuit chip or microcontroller 40 controls the operation of the flashlight 1 through selection by the user in operating the switch 24. The microcontroller 40 is a conventional device such as one of the PICs offered by Microchip Inc. A specific microcontroller that can be utilized in accordance with the invention is produced by Likki Plastic Manufactury, Ltd of Hong Kong as part number SNC112-SC112 EL002.

The microcontroller 40 includes an oscillator port 45 provided at a pin and operatively joined to the battery 21 to provide and operate a clock or timing function therein.

The microcontroller 40 also includes a reset function joined to the battery 21 through port 46. The switch 24 joins to the microcontroller 40 through a port 47. Positive and ground leads of the battery 21 join with the microcontroller 40 through connectors 50 and 51 respectively and the positive also through port 52. Outputs of the microcontroller 40 are directed to ports 55, 56 and 57. The output of ports 55, 56 and 57 operatively control transistors 37, 38 and 39 and consequently the banks 33, 34 and light 15 respectively.

When the switch 24 is in the open or off configuration seen in FIG. 3, the flashlight 1 is in the off mode. When a button 61 of the switch 24 is thereafter depressed, the switch 24 closes and electrical current is first channeled to port 57 to turn on red light LED 15. When the button 61 is again depressed, electrical current is then channeled to the ports 55 and 56 collectively so as to turn on the white light banks 33 and 34 simultaneously and continuously. A third depression of the thumb button 61 of the switch 24 causes the controller 40 to toggle to the fourth mode in which electrical current is intermittently channeled from ports 55, 56 and 57 to turn on the banks 33 and 34. In the last mode, the LEDs 14 of the banks 33 and 34 are simultaneously flashed in a pattern to provide an emergency signal, especially a SOS signal.

Preferably, the flashlight 1 operating modes include an off mode, a red map reading or directional red light mode, a bright illumination mode and an emergency signaling mode. As the user toggles from mode to mode by successive depression of the mode-selection switch 24, the LEDs 14 and 15 alternate from on and off positions depending on the desired and chosen lighting display mode. In the emergency signaling mode, all white light LEDs 14 cycle on and off in intervals so as to produce the conventional SOS signaling pattern. In the red map reading mode, all white light LEDS 14 are off with the center red light LED 15 on. In the bright illumination mode, all of the white light LEDs 14 are on and the red light LED 15 is off. In the off mode, all LEDs 14 and 15 are off. It is foreseen that other modes could be incorporated, such as a mode to produce a dim white light by activating only 1 or less than 6 of the white light LEDs 14. It is also foreseen that the center light or another could produce a directional or pointing red beam or could produce another color light for a different purpose.

In use, the user holds the flashlight 1 in one hand and manipulates the switch 24 by successive depression of the switch 24 to step through or toggle to the desired lighting display mode.

It is to be understood that while certain forms of the present invention have been illustrated and described herein, it is not to be limited to the specific forms or arrangement of parts described and shown.

What is claimed and desired to be secured by Letters Patent is as follows:

1. A flashlight comprising:

(a) a housing;

(b) a power source positioned in said housing;

(c) first and second light sources mounted on the housing; and (d) a single push button operating switch for selecting between a plurality of on modes of operation wherein said first and second light sources are separately illuminated in respective modes of operation and wherein each depression of the push button steps the flashlight through one of said modes of operation.

2. The flashlight as in claim 1 wherein:

(a) said switch is a single finger activated switch.

3. The flashlight in claim 1 wherein:

(a) said first light source is a plurality of white light emitting diodes.

4. The flashlight as in claim 3 wherein:

(a) said plurality of light emitting diodes are arranged in a circular configuration.

5. The flashlight as in claim 4 wherein:

(a) said configuration further includes one center light emitting diode and represents said second light source.

6. The flashlight as in claim 5 wherein:

(a) said center light emitting diode is a red light emitting diode.

7. The flashlight as in claim 5 including:

(a) a microcontroller for controlling selection and operation of said modes.

8. The flashlight as in claim 3 wherein:

(a) said second light source is a red light emitting diode.

9. The flashlight as in claim 1 wherein:

(a) one of said modes is an emergency signaling mode.

10. The flashlight as in claim 1 wherein:

(a) in said signaling mode said first light source is caused to flash in an SOS signal pattern.

11. The flashlight as in claim 1 wherein:

(a) one of said modes is a red light illumination mode.

12. The flashlight as in claim 1 wherein:

(a) one of said modes is a bright white light illumination mode.

13. A flashlight having a single push button switch that is placed and positioned so as to be adapted to be operated by a single thumb as said flashlight is held in a hand of a user associated with the thumb and a plurality of operational modes including:

(a) an off mode;

(b) a first illumination mode of a first light color;

(c) a second illumination mode of a second light color wherein successive activation of said switch by the thumb toggles a light display emanating from said flashlight through a pattern of said modes; and (d) said push button is configured such that each depression of the push button steps the flashlight to a different one of said operational modes.

14. The flashlight according to claim 13 wherein:

(a) said first light color is provided by white light LEDs; and (b) said second light color is provided by a red light LED.

15. The flashlight according to claim 14 wherein:

(a) said first illumination mode provides a visually continuous source of light; and including (b) a third illumination mode wherein said first illumination mode provides a visually discontinuous source of light.

16. The flashlight according to claim 15 wherein:

(a) in said third illumination mode said first light source is flashed in a SOS pattern.

17. In a flashlight having a light source the improvement comprising:

said light source having a single finger operated push button switch, said switch changes from mode to mode by a unitary depression of the push button, which steps the flashlight through all modes of operation comprising a first mode of visually continuous illumination and a second mode of discontinuous illumination utilizing said push button switch.

* * * * *